US008086118B2

(12) United States Patent
Watanabe

(10) Patent No.: US 8,086,118 B2
(45) Date of Patent: Dec. 27, 2011

(54) IMAGE FORMING APPARATUS

(75) Inventor: Mitsutoshi Watanabe, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 443 days.

(21) Appl. No.: 12/419,768

(22) Filed: Apr. 7, 2009

(65) Prior Publication Data

US 2009/0257762 A1 Oct. 15, 2009

Related U.S. Application Data

(60) Provisional application No. 61/043,807, filed on Apr. 10, 2008.

(51) Int. Cl.
*G03G 15/08* (2006.01)
*G03G 15/10* (2006.01)
*G03G 15/09* (2006.01)

(52) U.S. Cl. ..... 399/30; 399/62; 399/267

(58) Field of Classification Search ..... 399/29, 399/30, 62, 267
See application file for complete search history.

(56) References Cited

U.S. PATENT DOCUMENTS

2002/0022190 A1* 2/2002 Iizuka et al. ..... 430/110.4
2006/0045575 A1* 3/2006 Mabuchi et al. ..... 399/267

* cited by examiner

*Primary Examiner* — David Gray
*Assistant Examiner* — Joseph Wong
(74) *Attorney, Agent, or Firm* — Turocy & Watson, LLP

(57) ABSTRACT

In accordance with an embodiment of the embodiment of the invention, an image forming apparatus includes: an electrostatic image-bearing member; and a developing device. The developing device includes a developer-carrying member disposed to face the electrostatic image-bearing member, and a developer carried on the developer-carrying member. The developer includes a carrier having a volume-average particle size dc (μm) and a toner having a volume-average particle size dt (μm) of at most 5 μm and contained at a weight ratio C with respect to the carrier of from 5 to 10% and is controlled so as to provide a surface coverage F of the carrier with the toner of from 30 to 80% as calculated according to Formula (I): $F=(1/4)\times(dc/dt)\times(pc/pt)\times C$, wherein pc denotes a true specific gravity (–) of the carrier, pt denotes a toner absolute specific gravity (–), and C denotes a weight ratio (–) of the toner to the carrier.

18 Claims, 2 Drawing Sheets

IMAGE FORMING APPARATUS

CROSS REFERENCE TO RELATED APPLICATION

This application is based on and claims the benefit of priority from provisional U.S. Application 61/043,807 filed on Apr. 10, 2008, the entire contents of which are incorporated herein by reference.

TECHNICAL FIELD

The present invention relates to an improvement in image quality of an electrophotographic image forming apparatus, such as a copier or a printer, employing a two-component development system using a toner and a carrier.

BACKGROUND

In an electrophotographic image forming apparatus employing a two-component development system, reduction in toner particle size is being advanced, as a means for meeting the demand for high image quality and high resolution image from the market. However, due to the reduction in toner particle size, there arises a problem that a charge amount per unit weight of the toner is increased to result in a lower image density or a charge amount per particle of the toner is decreased to result in background fog. Similarly, it is possible to increase a developer density on a developer-carrying member and achieve a high resolution image by using a carrier having a reduced particle size. An apparatus including a carrier having a volume-average particle size of about 35 μm has been also placed on the market recently, but in this case, there arises a problem that such a carrier having a small particle size of 35 μm or less is liable to be attached to a photosensitive member.

SUMMARY OF THE INVENTION

Therefore, a principal object of the invention is to provide an image forming apparatus using a toner having a small particle size and a carrier having a small particle size capable of providing an improved image quality.

Another object of the invention is to provide a developing device to be used in the image forming apparatus.

More specifically, according to an aspect of the invention, there is provided an image forming apparatus comprising:

an electrostatic image-bearing member; and a developing device, wherein the developing device includes a developer-carrying member disposed to face the electrostatic image-bearing member, and a developer carried on the developer-carrying member, and the developer comprises a carrier having a volume-average particle size dc (μm) and a toner having a volume-average particle size dt (μm) of at most 5 μm and contained at a weight ratio C with respect to the carrier of from 5 to 10% and is controlled so as to provide a surface coverage F of the carrier with the toner of from 30 to 80% as calculated according to Formula (I) below:

$$F=(1/4)\times(dc/dt)\times(pc/pt)\times C, \qquad \text{Formula (1)}$$

wherein pc denotes a true specific gravity (–) of the carrier, pt denotes a toner absolute specific gravity (–), and C denotes a weight ratio (–) of the toner to the carrier.

DETAILED DESCRIPTION

Hereinafter, embodiments of the invention will be described.

Figure 1:
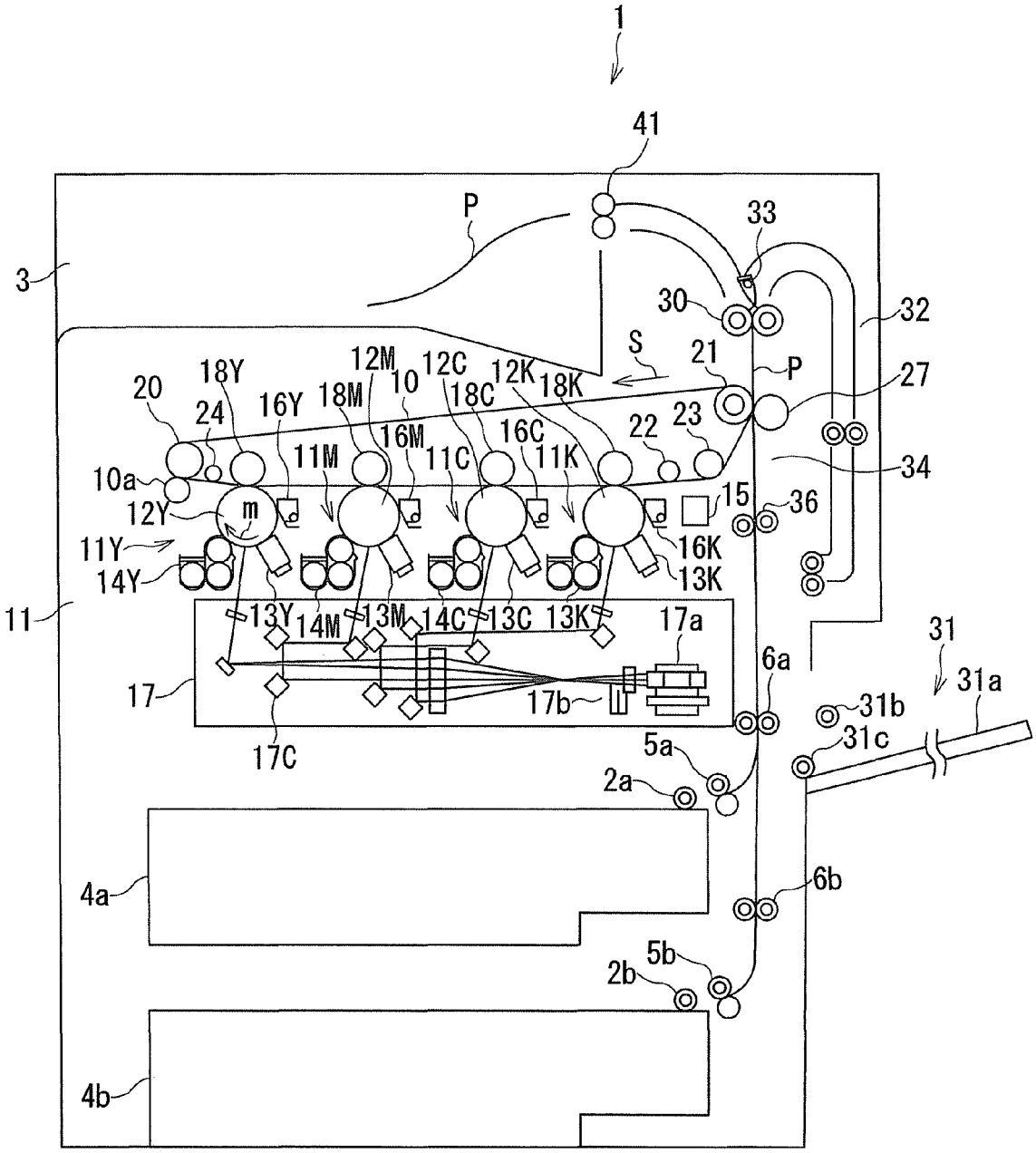
FIG. 1 is an overall arrangement view showing an image forming apparatus of a first embodiment of the invention.

FIG. 1 is a schematic arrangement view showing an overall organization of a color printer 1 of a first embodiment of the invention. The color printer 1 employs a four-drum tandem system. The color printer 1 is provided with a paper discharge section 3 at an upper section thereof.

The color printer 1 has an image forming unit 11 below an intermediate transfer belt 10. The image forming unit 11 includes four sets of processing units 11Y, 1M, 11C and 11K arranged in parallel along the intermediate transfer belt 10. The processing units 11Y, 11M, 11C and 11K form yellow (Y), magenta (M), cyan (C) and black (K) toner images, respectively.

Figure 2:
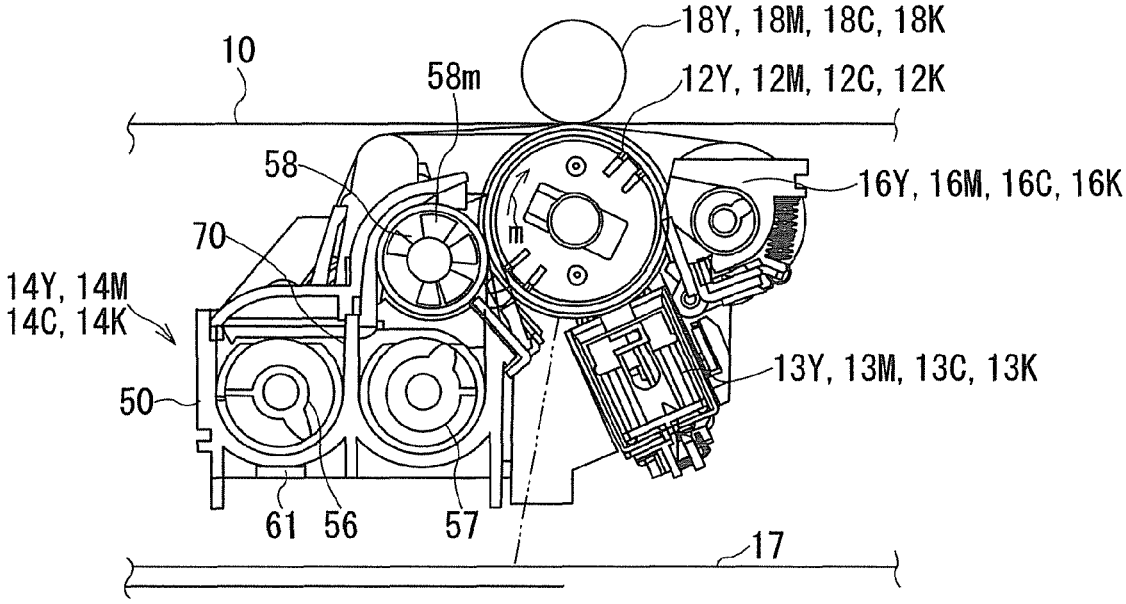
FIG. 2 is a schematic explanatory view showing an image forming unit of the first embodiment of the invention.

As shown in FIG. 2, the processing units 11Y, 1M, 11C and 11K have photosensitive drums 12Y, 12M, 12C and 12K, respectively, as image-bearing members, respectively. Each of the photosensitive drums 12Y, 12M, 12C and 12K rotates in the direction of an arrow m. Around the photosensitive drums 12Y, 12M, 12C and 12K, electric chargers 13Y, 13M, 13C and 13K, developing devices 14Y, 14M, 14C and 14K and photosensitive drum cleaners 16Y, 16M, 16C and 16K, for the respective drums, are disposed along the rotational direction.

Between each of the electric chargers 13Y, 13M, 13C and 13K and each of the developing devices 14Y, 14M, 14C and 14K, the photosensitive drums 12Y, 12M, 12C and 12K, light are irradiated with light from a laser exposing device 17. The laser exposing device 17 scans a laser beam emitted from its semiconductor laser element in the axial direction of the photosensitive drum 12 and includes a polygon mirror 17*a*, an imaging lens system 17*b*, a mirror 17*c*, etc. In this manner, electrostatic latent images are formed on the respective photo-sensitive drums 12Y, 12M, 12C and 12K. Each of the electric chargers 13Y, 13M, 13C and 13K and the laser exposing device 17 constitute a latent image forming section. In the vicinity of the image forming unit 11 of the color printer 1, a temperature and humidity sensor 15 is provided as an environment detector.

Each of the developing devices 14Y, 14M, 14C and 14K develops each of the latent images on the photosensitive drums 12Y, 12M, 12C and 12K. Each of the developing devices 14Y, 14M, 14C and 14K performs development using a two-component developer containing a carrier and each toner of yellow (Y), magenta (M), cyan (C) and black (K).

The intermediate transfer belt 10 is disposed under tension around a backup roller 21, a driven roller 20 and first to third tension rollers 22 to 24 and is rotated in the direction of an arrow S.

The intermediate transfer belt 10 faces and is in contact with the photosensitive drums 12Y, 12M, 12C and 12K. At the positions where the intermediate transfer belt 10 faces the photosensitive drums 12Y, 12M, 12C and 12K, primary transfer rollers 18Y, 18M, 18C and 18K are provided, respectively. Each of the primary transfer rollers 18Y, 18M, 18C and 18K primarily transfers the toner image formed on each of the photosensitive drums 12Y, 12M, 12C and 12K to the intermediate transfer belt 10. Each of the photosensitive drum cleaners 16Y, 16M, 16C and 16K removes and recovers residual toner on each of the photosensitive drums 12Y, 12M, 12C and 12K after the primary transfer.

A secondary transfer roller 27 is disposed to face a secondary transfer section of the intermediate transfer belt 10 supported by the backup roller 21. At the secondary transfer section, a predetermined secondary transfer bias is applied to the backup roller 21. When a sheet paper P passes between the intermediate transfer belt 10 and the secondary transfer roller 27, the toner image on the intermediate transfer belt 10 is secondarily transferred to the sheet paper P. The sheet paper P is fed from a paper feed cassette 4*a* or 4*b* or a manual feed mechanism 31. After the secondary transfer, the intermediate transfer belt 10 is cleaned by a belt cleaner 10*a*.

Along the path from the paper feed cassettes 4*a* and 4*b* to the secondary transfer roller 27, pickup rollers 2*a* and 2*b*, separation rollers 5*a* and 5*b*, conveying rollers 6*a* and 6*b* and a resist roller pair 36 are provided. Along the path from a manual feed tray 31*a* of the manual feed mechanism 31 to the resist roller pair 36, a manual feed pickup roller 31*b* and a manual feed separation roller 31*c* are provided. Further, along a vertical conveying path 34, a fixing device 30 is provided downstream of the secondary transfer section. The fixing device 30 fixes the toner image transferred to the sheet paper P at the secondary transfer section on the sheet paper P. Downstream of the fixing device 30, a gate 33 which guides the sheet paper P to either a paper discharge roller 41 or a reconveying unit 32 is provided. A sheet paper P guided to the paper discharge roller 41 is discharged to a paper discharge section 3. A sheet paper P guided to the reconveying unit 32 is guided to the secondary transfer roller 27 again.

The developing devices 14Y, 14M, 14C and 14K have the same configurations, and therefore, a description will be made using common symbols. As shown in FIG. 2, each of the developing devices 14Y, 14M, 14C and 14K has a case 50 which is a developer container, a developing roller 58, a first mixer 56 and a second mixer 57 which are stirring and conveying members, and a toner concentration sensor 61 which is a toner concentration detector.

By carrying a developer which is composed of a carrier and a toner and is magnetically attracted by a built-in magnet 58*m* on a developer-carrying member (developing roller) 58 and rubbing the electrostatic image-bearing member (photosensitive drum) 12 (Y, M, C, or K) with a magnetic brush formed on the developer-carrying member 58, the toner is attached to the electrostatic latent image on the electrostatic image-bearing member 12 to effect development.

The developer to be used in the image forming apparatus comprises a carrier having a volume-average particle size dc (μm) and a toner having a volume-average particle size dt (μm) of at most 5 μm and contained at a weight ratio C with respect to the carrier of from 5 to 10% and is controlled so as to provide a surface coverage F of the carrier with the toner of from 30 to 80% as calculated according to Formula (I) below:

$$F=(1/4)\times(dc/dt)\times(pc/pt)\times C, \qquad \text{Formula (1)}$$

wherein pc denotes a true specific gravity (–) of the carrier, pt denotes a toner absolute specific gravity (–), and C denotes a weight ratio (–) of the toner to the carrier.

As a core material of the carrier, a metal such as surface-oxidized or -unoxidized iron, nickel, copper, zinc, cobalt, manganese, chromium or a rare earth metal, an alloy or an oxide of these, a ferrite or the like, for example, can be used. The carrier surface may be coated with, for example, polytetrafluoroethylene, monochlorotrifluoroethylene polymer, polyvinylidene fluoride, a silicone resin, a polyester resin, a metal complex of di-tert butyl salicylic acid, or a resin, such as a styrene resin or an acrylic resin. As a preferred embodiment of the carrier, a carrier obtained by coating the surface of ferrite particles, such as Cu—Zn ferrite or Mn—Mg ferrite particles, with a silicone resin may be exemplified. The volume-average particle size of such a carrier is generally in a range of from 10 to 100 μm, preferably 35 μm or less, particularly preferably in a range of from 20 to 30 μm, as measured according to the micro-track method.

By appropriately combining a core material and a coating resin as described above, the carrier may preferably have a resistivity of $10^6\Omega$ or higher when 1000 V/mm is applied and a magnetic moment of from 10 to 70 emu/g when a magnetic field of 1000 oersted is applied.

If the carrier resistivity is below $10^6\Omega$, charge injection from a sleeve to the carrier is liable to occur when a development voltage is applied and a potential difference between a photosensitive member surface potential of a non-image area (V0) and a potential of the developer-carrying member (Vb) increases, whereby carrier attachment to the photosensitive member is liable to occur.

Further, by setting the magnetic moment of the carrier to 70 emu/g or less, an ear-forming force of a developer magnetic brush at a development pole can be decreased and attachment of fogging toner due to a pressing force of the developer magnetic brush can be decreased. Further, from the viewpoint of dot reproducibility and thin-line reproducibility, the developer magnetic brush can be made dense and a higher image quality can be achieved.

The toner constituting the developer in combination with the carrier as described above is composed of a composition obtained by blending a colorant suitable for providing each color of yellow (Y), magenta (M), cyan (C) and black (K) and a charge controlling agent such as a Zr complex for imparting a suitable triboelectric chargeability to the toner within a resin, such as a polyester resin, a polystyrene resin, a styrene/acrylate copolymer resin, a polyester-styrene/acrylate hybrid resin, an epoxy resin or a polyether-polyol resin. Such a composition may be formed into toner (mother) particles having a volume-average particle size of 5 μm or smaller (based on a particle size distribution measured by a Coulter counter with an aperture of 100 μm (lower measurement limit: 1.26 μm)) of by a pulverization process or a wet process including a polymerization process. Then, the thus-obtained toner particles may be blended with inorganic fine particles of titanium oxide, silica, etc., having a volume-average particle size of from 10 to 500 nm for improving an improved fluidity, whereby a toner may be obtained. As the inorganic fine particles, generally those having a small particle size, specifically, having a volume-average particle size of from 10 to 100 nm are used, but, for the purpose of reducing the attaching force of the toner particles per se, inorganic particles having a larger particle size having a volume-average particle size of from, for example, 100 to 500 nm can also be used in combination. Incidentally, the average particle size of the toner may be determined substantially by the average particle size of the toner mother particles alone and the existence of these inorganic particles having a smaller particle size does not substantially affect it. The volume-average particle size of the toner to be used is 5 μm or smaller, preferably in a range of from 3.0 to 4.8 μm. Use of the toner having a volume-average particle size exceeding 5 μm is not preferred in view of the object of the invention of improving image qualities including dot reproducibility and thin-line reproducibility by using a toner having a small particle size.

The above toner is used in such a concentration ratio that a weight ratio C of the toner to the carrier is from 5 to 10%. If the toner concentration ratio is less than 5%, a sufficient image density cannot be obtained, and if the toner concentration ratio is too high, a problem of background fog or toner scattering occurs.

Further, even if the condition of the above-mentioned toner concentration ratio is satisfied, it is necessary to set the toner coverage F on the carrier surface represented by the above formula (I) to 30 to 80%. If the coverage F exceeds 80%, the toner cannot be sufficiently charged, thereby to result in background fog or toner scattering even in a case where the toner concentration ratio is in the above-mentioned range.

If the toner coverage F on the carrier surface is less than 30%, carrier attachment is liable to occur even if the toner concentration ratio is in the above-mentioned range. This is presumably because the particle size of the carrier becomes relatively smaller and the particle size of the toner in the developer on the developer-carrying member is smaller than that of the carrier, and therefore, the toner functions as a spacer among the carrier particles to inhibit the magnetic constraint force.

In order to control the coverage F to fall within the range of from 30 to 80%, the toner volume-average particle size dt, the carrier volume-average particle size dc and the weight concentration ratio C of the toner to the carrier (to fall within a range of from 5 to 10%) may principally be controlled, among the variables in the formula (I). Further, it is also preferred to have a mechanism of increasing and decreasing the concentration ratio C of the toner to the carrier in the developer so as to control the coverage F represented by the formula (I) to fall within the range of from 30 to 80% by controlling the supply rate of the toner to the developing device based on the output of the toner concentration sensor 61 in the developing device 14 and depending on the volume-average particle size dt of the used toner and the volume-average particle size dc of the used carrier.

As a preferred development method, a method performed under the following development conditions can be exemplified: a peak-to-peak voltage (Vp-p) in an alternate electric field to be applied between the developer-carrying member 58 and the photosensitive member 12 is 500 V or more and 1500 V or less; a potential difference (Vbg) between a photosensitive member surface potential of a non-image area (V0) and a potential of the developer-carrying member (Vb) is 100 V or more and 200 V or less; a width of a gap between the developer-carrying member 58 and the photosensitive member 12 is from 0.25 to 0.50 mm; a development frequency is from 7 to 15 kHz; and a gap between the photosensitive member and the developer-carrying member is from 0.1 to 0.5 mm; and an amount of the developer on the developer-carrying member is from 0.2 to 1.0 mg/cm$^2$.

If Vp-p is below the above range, it becomes difficult to separate the toner from the carrier by an oscillating electric field, and therefore, a decrease in image density is liable to occur. If Vp-p is higher than the above range, carrier attachment to the photosensitive member is liable to occur. Further, if the potential difference (Vbg) between a photosensitive member surface potential of a non-image area (V0) and the potential of the developer-carrying member (Vb) is below the above range, the toner separated from the carrier and attached to a non-image area of the latent image on the photosensitive member is not recovered to the side of a development pole and background fog occurs. If Vbg is higher than the above range, charge injection to the carrier is liable to occur, thereby being liable to cause carrier attachment. Further, if the development frequency is below the above range, it becomes difficult to achieve selective development by a toner charge amount, thereby being liable to cause fog in a non-image area on the photosensitive member. If the development frequency is higher than the above range, there is a tendency to increase the cost of a voltage supply plate itself. If the gap between the photo-sensitive member and the developer-carrying member is smaller than the above range, developer clogging is liable to occur thereby to cause image failure. If it is larger than the above range, a decrease in image density is liable to occur. If the amount of the developer on the developer-carrying member is less than the above range, an amount of the developer supplied is insufficient thereby to cause a decrease in image density. If it is more than the above range, developer clogging is liable to occur thereby to cause image failure.

Further, in the developing device 14, it is preferred to control an electric charge such that a charge amount of the toner falls within a range of from 10 to 70 μC/g, when the toner coverage F on the carrier surface is 50%.

In the invention, it is possible to incorporate a charge control agent for controlling the triboelectric chargeability. As a charge control agent to be externally added to the toner, a metal-containing azo compound may be used, including as preferred examples thereof, complexes and complex salts of metals, such as iron, cobalt and chromium, and mixtures of these. Further, it is also possible to use a metal-containing salicylic acid derivative, of which preferred examples may include complexes and complex salts of metals, such as zirconium, zinc, chromium and boron, and mixtures of these.

Colorants forming the toners may comprise carbon black, and organic and inorganic pigments and dyes. While not particularly limited, the carbon black may include acetylene black, furnace black, thermal black, channel black and ketjen black. The pigments and dyes may include: Fast Yellow G, Benzidine Yellow, Indofast Orange, Irgadine Red, NaphtholAzo, Carmine FB, Permanent Bordeaux FRR, Pigment Orange, Lithol Red 29, Lake Red C, Rhodamine FB, RhodamineBLake, PhthalocyanineBlue, Pigment Blue, Brilliant Green, Phthalocyanine Green, and Quinacridones. These colorants may be used singly or in mixture.

Hereinafter, the invention will be more specifically described with reference to Examples. Thus, an image forming test was performed under an environment of 25° C. and 45 RH % using a remodelled machine which was obtained by remodelling e-STUDIO 3510 manufactured by Toshiba Tec Corporation to have a configuration as described with reference to FIGS. 1 and 2 and so that the Vp-p and frequency of the developing field could be changed by an external power supply. As a basic set of development conditions, a difference Vc between the potential of the developer-carrying member (Vb) and the residual potential of the exposed area of the photosensitive member (Ver) was set to 450 V; a difference Vbg between the potential of the developer-carrying member (Vb) and the potential of the non-exposed area of the photosensitive member (V0) was set to 125 V (the detail of the other development conditions are shown in Table 2 shown below). As the evaluation items, background fog, carrier attachment, solid image density, half tone roughness, and dot reproducibility, were evaluated.

For the evaluation, the following carriers I and II were used.

Carrier I: A carrier having a volume-average particle size of 28.4 μm was obtained by using an Mn—Mg ferrite as a core material and coating the core material with a silicone resin. The carrier had a resistivity of $1.0\times10^9\Omega$ when 1000 V was applied. Further, the carrier had a magnetic moment of 56 emu/g when a magnetic field of 1000 oersted was applied.

Carrier II: A carrier which had a volume-average particle size of 42.4 μm and was obtained by using a Mn—Mg ferrite as a core material and coating the core material with a silicone resin. The carrier had a resistivity of $1.1\times10^{9}\Omega$ when 1000 V was applied. Further, the carrier had a magnetic moment of 56 emu/g when a magnetic field of 1000 oersted was applied.

Toners I-V to be combined with the carriers were formed from magenta toner mother particles comprising silicone resin as the base resin in the following manner, while toners of other colors can of course be used in the invention.

Toner I: Prepared by externally adding 1.2 parts by weight of silica fine particles having a volume-average particle size of 30 nm as inorganic fine particles to 100 parts by weight of the toner mother particles having a volume-average particle size of 4.0 μm so as to be attached to the surfaces of the toner mother particles.

Toner II: Prepared in the same manner as Toner I except that 6 parts by weight of silica fine particles having a volume-average particle size of 110 nm were further externally added with respect to 100 parts by weight of the toner mother particles.

Toner III: Prepared in the same manner as Toner I except that toner mother particles having a volume-average particle size of 6.8 μm were used.

Toner IV: Prepared in the same manner as Toner I except that toner mother particles having a volume-average particle size of 8.0 μm were used.

Toner V: Prepared in the same manner as Toner I except that toner mother particles having a volume-average particle size of 4.8 μm were used.

Image formation was performed using a cyan (C) image forming unit including a developing device 14M and a photosensitive drum 12M of a four-color image forming apparatus shown in FIG. 1. The conditions for the image formation and the results of the evaluation tests are summarized in Tables 1 and 2 below.

[Evaluation Standards]

Evaluation for the respective evaluation items were performed as follows.

(Image Density)

Evaluated based on the level of Vc (=Vb(potential of the developer-carrying member)−Ver (residual potential of exposed area of the photosensitive drum)) for providing an image density of 1.25 at a solid image part as measured by a MacBeth densitometer available from Sakata Inks K.K. according to the following standard.

A: 300 V≦Vc<450 V

B: 450 V≦Vc≦600 V

C: Vc>600 V or an image density of 1.25 could not be obtained.

(Background Fog)

Evaluated based on a color difference ⊿E at a white background part measured at Vbg (=V0(potential at white background part)−Vb) of 125 V by means of a spectral calorimeter available from X-Rite Co., according to the following standard.

A+: ⊿E<1.0

A: 1.0≦⊿E<2.0

B: 2.0≦⊿E<3.0

C: 3.0≦⊿E (Carrier Attachment)

After interruption of image formation, the photosensitive drum was uncovered, and the number of carriers attached to an area of 340 $mm^2$ on the photosensitive drum corresponding to a white background portion during the image formation at Vbg=250 V was counted. The evaluation was performed based on the number of the attached carriers (per 340 $mm^2$) according to the following standard.

A: ≦30

B: 30<the number<50

C: ≧50

TABLE 1

| | Toner | Carrier | Toner concentration ratio C (%) | Coverage (%) | Q/M (μC/g) | Image density | Background fog | Carrier attachment |
|---|---|---|---|---|---|---|---|---|
| Example 1 | I | I | 8.4 | 64.4 | 39.8 | A | A | A |
| Example 2 | II | I | 8.1 | 54.2 | 23.7 | A | A+ | A |
| Comparative example 1 | I | I | 12.3 | 82.4 | 21.4 | A | C | A |
| Comparative example 2 | I | I | 3.5 | 23.4 | 63.7 | C | A | C |
| Comparative example 3 | I | II | 12.6 | 144.3 | 18.8 | A | C | A |
| Comparative example 4 | I | II | 8.3 | 95 | 23.2 | A | C | A |
| Comparative example 5 | I | II | 3.8 | 43.5 | 36.4 | C | B | A |
| Comparative example 6 | II | II | 8.3 | 95 | 19.9 | A | C | A |
| Comparative example 7 | II | II | 4.2 | 48.1 | 27.3 | C | B | A |
| Comparative example 8 | II | II | 12.8 | 146.6 | 18.2 | A | C | A |
| Comparative example 9 | III | I | 3.4 | 13.4 | 42.8 | C | A | C |
| Comparative example 10 | III | I | 8.1 | 31.9 | 36.9 | B | A | C |
| Comparative example 11 | III | A | 12.8 | 50.4 | 28.8 | A | B | B |
| Comparative example 12 | IV | A | 4.1 | 13.7 | 40.2 | A | A | C |
| Comparative example 13 | IV | A | 7.5 | 25.1 | 33.3 | C | A | B |
| Comparative example 14 | IV | A | 12.2 | 40.9 | 28.9 | A | C | A |

TABLE 2

| | Development conditions | | | |
|---|---|---|---|---|
| | Vp-p (V) | Frequency (kHz) | Amount of carried developer (mg/cm$^2$) | Gap between photosensitive member and development pole (mm) |
| Example 1 | 1000 | 10 | 0.35 | 0.35 |
| Example 2 | 1000 | 10 | 0.41 | 0.35 |
| Comparative example 1 | 1000 | 10 | 0.35 | 0.35 |
| Comparative example 2 | 1000 | 10 | 0.42 | 0.35 |
| Comparative example 3 | 1000 | 10 | 0.38 | 0.35 |
| Comparative example 4 | 1000 | 10 | 0.42 | 0.35 |
| Comparative example 5 | 1000 | 10 | 0.36 | 0.35 |
| Comparative example 6 | 1000 | 10 | 0.42 | 0.35 |
| Comparative example 7 | 1000 | 10 | 0.5 | 0.35 |
| Comparative example 8 | 1000 | 10 | 0.37 | 0.35 |
| Comparative example 9 | 1000 | 10 | 0.31 | 0.35 |
| Comparative example 10 | 1000 | 10 | 0.33 | 0.35 |
| Comparative example 11 | 1000 | 10 | 0.35 | 0.35 |
| Comparative example 12 | 1000 | 10 | 0.37 | 0.35 |
| Comparative example 13 | 1000 | 10 | 0.38 | 0.35 |
| Comparative example 14 | 1000 | 10 | 0.32 | 0.35 |

From the results shown in the above Tables 1 and 2, particularly Table 1, it is found that in Examples 1 and 2 in which the developer was formed under the conditions that a toner having a volume-average particle size of 5 μm or less (and a carrier having a volume-average particle size of preferably 35 μm or less) was used at a weight concentration ratio of the toner to the carrier of from 5 to 10% and the toner coverage F on the carrier surface was in the range of from 30 to 80%, an excellent image quality with respect to each of the evaluation items of image density, background fog and carrier attachment was obtained, on the other hand, in Comparative examples 1 to 14 which failed to satisfy some of these conditions, harmonized image quality with respect to these evaluation items was not obtained.

What is claimed is:

1. An image forming apparatus comprising:

an electrostatic image-bearing member; and a developing device, wherein the developing device includes a developer-carrying member disposed to face the electrostatic image-bearing member, and a developer carried on the developer-carrying member, and the developer comprises a carrier having a volume-average particle size dc (μm) and a toner having a volume-average particle size dt (μm) of at most 5 μm and contained at a weight ratio C with respect to the carrier of from 5 to 10% and is controlled so as to provide a surface coverage F of the carrier with the toner of from 30 to 80% as calculated according to Formula (I) below:

$$F=(1/4)\times(dc/dt)\times(pc/pt)\times C, \quad \text{Formula (1)}$$

wherein pc denotes a true specific gravity (–) of the carrier, pt denotes a toner absolute specific gravity (–), and C denotes a weight ratio (–) of the toner to the carrier.

2. The apparatus according to claim 1, wherein the carrier comprises a magnetic core and a coating resin on a surface of the core, has a resistivity of $10^6\Omega$ or higher at an applied electric field of 1000 V/mm is applied and a magnetic moment of from 10 to 70 emu/g at an applied magnetic field of 1000 oersted.

3. The apparatus according to claim 1, wherein the magnetic core of the carrier comprises an Mn—Mg ferrite.

4. The apparatus according to claim 1, wherein the magnetic core of the carrier comprises a Cu—Zn ferrite.

5. The apparatus according to claim 1, wherein the developing device controls an electric charge so as to provide a charge amount per toner weight falls within a range of from 10 to 70 μC/g at a toner coverage on the carrier surface in the developer of 50%.

6. The apparatus according to claim 1, wherein the toner is a toner produced though a pulverization process.

7. The apparatus according to claim 1, wherein the toner is a toner produced through a wet process.

8. The apparatus according to claim 1, wherein the toner comprises toner mother particles and externally added inorganic fine particles having a volume-average particle size of from 10 to 500 nm.

9. The apparatus according to claim 1, wherein the developing device includes a toner concentration sensor and a mechanism which controls a toner supply rate so as to provide a coverage F according to the formula (I) falls within a range of from 30 to 80% based on a detected toner concentration ratio C depending on predetermined carrier particle size dc and toner particle size dt.

10. The apparatus according to claim 1, wherein the toner is a toner produced though a pulverization process.

11. The apparatus according to claim 1, wherein the toner is a toner produced through a wet process.

12. The apparatus according to claim 1, wherein the toner comprises toner mother particles and externally added inorganic fine particles having a volume-average particle size of from 10 to 500 nm.

13. A developing device comprising:

a developer-carrying member; and a developer carried on the developer-carrying member, wherein the developer comprises a carrier having a volume-average particle size dc (μm) and a toner having a volume-average particle size dt (μm) of at most 5 μm and contained at a weight ratio C with respect to the carrier of from 5 to 10% and is controlled so as to provide a surface coverage F of the carrier with the toner of from 30 to 80% as calculated according to Formula (I) below:

$$F=(1/4)\times(dc/dt)\times(pc/pt)\times C, \quad \text{Formula (1)}$$

wherein pc denotes a true specific gravity (–) of the carrier, pt denotes a toner absolute specific gravity (–), and C denotes a weight ratio (–) of the toner to the carrier.

14. The device according to claim 13, wherein the carrier comprises a magnetic core and a coating resin on a surface of the core, has a resistivity of $10^6\Omega$ or higher at an applied electric field of 1000 V/mm is applied and a magnetic moment of from 10 to 70 emu/g at an applied magnetic field of 1000 oersted.

15. The device according to claim 13, wherein the magnetic core of the carrier comprises an Mn—Mg ferrite.

16. The device according to claim 13, wherein the magnetic core of the carrier comprises a Cu—Zn ferrite.

17. The device according to claim 13, wherein the developing device controls an electric charge so as to provide a charge amount per toner weight falls within a range of from 10 to 70 μC/g at a toner coverage on the carrier surface in the developer of 50%.

18. The device according to claim 13, further including a toner concentration sensor and a mechanism which controls a toner supply rate so as to provide a coverage F according to the formula (1) falls within a range of from 30 to 80% based on a detected toner concentration ratio C depending on predetermined carrier particle size dc and toner particle size dt.

* * * * *